US007776198B2

(12) United States Patent
Rasmussen

(10) Patent No.: US 7,776,198 B2
(45) **Date of Patent: *Aug. 17, 2010**

(54) METHOD FOR ANODIZING OBJECTS

(75) Inventor: Jean Rasmussen, Maribel, WI (US)

(73) Assignee: Pioneer Metal Finishing, LLC, Green Bay, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/352,332

(22) Filed: Jan. 12, 2009

(65) Prior Publication Data

US 2009/0159450 A1 Jun. 25, 2009

Related U.S. Application Data

(63) Continuation of application No. 11/287,664, filed on Nov. 28, 2005, now abandoned, which is a continuation of application No. 10/330,855, filed on Dec. 27, 2002, now Pat. No. 7,060,176, which is a continuation of application No. 09/840,353, filed on Apr. 23, 2001, now Pat. No. 6,562,223, which is a continuation of application No. 09/475,916, filed on Dec. 30, 1999, now Pat. No. 6,254,759, which is a continuation of application No. 09/046,388, filed on Mar. 23, 1998, now Pat. No. 6,126,808.

(51) Int. Cl.
*C25D 5/08* (2006.01)
*C25D 5/18* (2006.01)
*C25D 11/04* (2006.01)

(52) U.S. Cl. ..... 205/104; 205/105; 205/108; 205/133; 205/148; 205/324

(58) Field of Classification Search ..... 205/104, 205/105, 108, 324
See application file for complete search history.

(56) References Cited

U.S. PATENT DOCUMENTS 3,857,766 A * 12/1974 Woods ..... 205/108
3,975,254 A * 8/1976 Elco et al. ..... 204/229.3
3,983,014 A * 9/1976 Newman et al. ..... 205/107
4,046,649 A * 9/1977 Elco et al. ..... 205/107
4,152,221 A * 5/1979 Schaedel ..... 205/108

(Continued)

*Primary Examiner*—Patrick Ryan
*Assistant Examiner*—William T Leader
(74) *Attorney, Agent, or Firm*—George R. Corrigan

(57) ABSTRACT

A method and apparatus of anodizing a component, preferably aluminum, is disclosed. The component is placed in an electrolyte solution. A number of pulses are applied to the solution and component. Each pulse is formed by a pattern including having three magnitudes. The third magnitude is less, preferably substantially less, than the first and second magnitudes, and all three magnitudes are of the same polarity. The pulse pattern may include alternations between the first and second magnitudes, and following the alternations, the third magnitude. Other patterns may be provided. The solution is in a reaction chamber, along with at least a portion of the component. The fluid enters the reaction chamber from a transport chamber through a plurality of inlets directed toward the component, preferably at an angle of between 60 and 70 degrees. The inlet is preferably the cathode, and the component is the anode, whereby current flows between the cathode and the anode in another embodiment. The inlets are in a side wall such that the fluid enters the reaction chamber substantially horizontally. The reaction chamber has at least one outlet beneath the inlets. The outlet may be in a bottom wall. The fluid follows a return path, such that the fluid returns from the reaction chamber to the transport chamber. The component is held in a mounted position mechanically or pneumatically in various alternatives.

8 Claims, 6 Drawing Sheets

U.S. PATENT DOCUMENTS 4,225,399 A * 9/1980 Tomita ..... 205/148
4,414,077 A * 11/1983 Yoshida et al. ..... 205/105
4,517,059 A * 5/1985 Loch et al. ..... 205/83
4,571,287 A 2/1986 Okubo et al.
4,981,559 A * 1/1991 Sato et al. ..... 205/80
5,032,244 A * 7/1991 Bommier et al. ..... 204/224 R
5,173,161 A * 12/1992 Gramm ..... 204/232
5,181,154 A 1/1993 Haupt et al.
5,514,258 A * 5/1996 Brinket et al. ..... 204/237
5,534,126 A * 7/1996 Stadler et al. ..... 205/101
5,597,460 A 1/1997 Reynolds
5,753,099 A * 5/1998 Gravel et al. ..... 205/565
6,126,808 A * 10/2000 Rasmussen ..... 205/324
6,254,759 B1 * 7/2001 Rasmussen ..... 205/324
6,562,223 B2 * 5/2003 Rasmussen ..... 205/324
7,060,176 B2 * 6/2006 Rasmussen ..... 205/104

* cited by examiner

METHOD FOR ANODIZING OBJECTS

This is a continuation of, and claims the benefit of the filing date of U.S. patent application Ser. No. 11/287,664, filed on Nov. 28, 2005, now abandoned, which is a continuation of, and claims the benefit of the filing date of, U.S. patent application Ser. No. 10/330,855, filed on Dec. 27, 2002, which issued as U.S. Pat. No. 7,060,176 on Jun. 13, 2003, which is a continuation of, and claims the benefit of the filing date of, U.S. patent application Ser. No. 09/840,353, filed Apr. 23, 2001, entitled Method And Apparatus For Anodizing Objects, which issued as U.S. Pat. No. 6,562,223 on May 13, 2003, which is a continuation of, U.S. patent application Ser. No. 09/475,916, filed Dec. 30, 1999, entitled Method And Apparatus For Anodizing Objects, which issued as U.S. Pat. No. 6,254,759 on May 13, 2003, which is a continuation of U.S. patent application Ser. No. 09/046,388, filed Mar. 23, 1998, entitled Method and Apparatus For Anodizing Objects which issued as U.S. Pat. No. 6,126,808 on Oct. 3, 2000.

FIELD OF THE INVENTION

The present invention relates generally to the art of electrolytic formation of coatings on metallic parts. More specifically, it relates to electrolytic formation of a coating on a metallic substrate by cathodic deposition of dissolved metallic ions in the reaction medium (electrolyte) onto the metallic substrate (cathode), or anodic conversion of the metallic substrate (anode) into an adherent ceramic coating (oxide film).

BACKGROUND OF THE INVENTION

It is well known that many metallic components or parts need a final surface treatment. Such a surface treatment increases functionality and the lifetime of the part by improving one or more properties of the part, such as heat resistance, corrosion protection, wear resistance, hardness, electrical conductivity, lubricity or by simply increasing the cosmetic value.

One example of a part that is typically surface treated is the head of aluminum pistons used in combustion engines. (As used herein an aluminum component is a component at least partially comprised of aluminum, including aluminum alloys.) Such piston heads are in contact with the combustion zone, and thus exposed to relatively hot gases. The aluminum is subjected to high internal stresses, which may result in deformation or changes in the metallurgical structure, and may negatively influence the functionality and lifetime of the parts. It is well known that formation of an anodic oxide coating (anodizing) reduces the risk of aluminum pistons performing unsatisfactorily. Thus, many aluminum piston heads are anodized.

There is a drawback to anodizing piston heads. Conventional anodizing with direct current or voltage, increases the surface roughness of the initial aluminum surface by applying an anodic coating. The increase in surface roughness can be as high as 400%, depending on the aluminum alloy and process conditions. The amount of VOC (Volatile Organic Compounds) in the exhaust of a combustion engine is correlated with the surface finish of the anodized aluminum piston: higher surface roughness reduces the efficiency of the combustion, because a greater proportion of organic compounds can be trapped in micro cavities more easily. Therefore, a smooth surface is required, which may not always be provided by anodization.

A typical prior art power supply for the conversion of metallic aluminum into a ceramic coating (aluminum oxide or alumna) provides direct current, normally between 3 and 4 A/dm2. Typically, a film thickness of 20 to 25 microns is reached after 30 to 40 minutes.

Convention anodizing includes subjecting the aluminum to an acid electrolyte, typically composed of sulfuric acid or electrolyte mixed with sulfuric and oxalic acid. The anodizing process is generally performed in electrolytes containing 12 to 15% v/v sulfuric acid at relatively low process temperature, such as from −5 to +5 degrees C. Higher concentrations and temperature usually decrease the formation rate significantly. Also, the formation voltage decreases with higher temperature, which adversely affects the compactness and the technical properties of the oxide film.

Performing anodizing process at (relatively) low temperature and fairly high current density increases the compactness and technical quality of the coating performance (high hardness and wear resistance). The anodization produces a significant amount of heat. Some heat is the result of the exothermic nature of the anodizing of aluminum. However, the majority of the heat is generated by the resistance of the aluminum towards anodizing. Typically, the reaction polarization is high, such as from 15-30 volts, depending upon the composition of the alloying elements and the process conditions. Given typical current densities, from 80% to 95% of the total heat production will be resistive heat.

The electrolyte is acidic, and thus chemically dissolves the aluminum oxide. Thus, the net formation of the coating (aluminum oxide) depends on the balance between electrolytic conversion of aluminum into aluminum oxide and chemical dissolution of the formed aluminum oxide.

The rate of chemical dissolution increases with heat. Thus, the total production of heat is a significant factor influencing this balance and helps determines the final quality of the anodic coating. Heat should be dispersed form areas of production toward the bulk solution at a rate that prevents excess heating of the electrolytic near the aluminum part. If the balance between formation and dissolution is not properly struck, and dissolution is favored, the oxide layer may develop holes, exposing the alloy to the electrolyte. This often happens in prior art anodization methods and is known as a "burning phenomena".

Heat produced at the aluminum surface is dispersed by air agitation or mechanically stirring of the electrolyte in which the oxidation of aluminum is taking place, in the prior art, to help reach the desired balance.

Another way of dispersing the heat is by spraying the electrolyte toward the aluminum surface (U.S. Pat. No. 5,534,126 and U.S. Pat. No. 5,032,244). The electrolyte is sprayed toward the aluminum surface at an angle of 90 degrees, moving heat toward the areas of production, and then symmetrically dispersed away from the aluminum surface.

Another way to disperse heat is to pump the electrolyte over the aluminum substrate (U.S. Pat. No. 5,173,161). The electrolyte is moved parallel to the aluminum surface, moving heat from the lower part of the aluminum substrate over the entire surface before it is finally dispersed away from the aluminum surface.

A steady state transport mechanism in electrochemical analysis (not anodization) techniques based on wall jet processes can be achieved by either rotating the working electrode, or by directing the flow toward a stationary electrode, at an angle of between 60 and 70 degrees. By angling the jet stream of the reaction medium to 60-70 degrees where steady state conditions are obligatory, electrochemical analysis can be made. Steady state conditions in a jet stream orthogonal to the working electrode is less suitable for wall jet electrochemical analysis. The inventor is not aware of this information having been applied to an electrolytic process.

The driving force of the charge-transfer reaction taking place at the substrate surface in the process described in U.S. Pat. Nos. 5,032,244, 5,534,126 and 5,173,161, was direct current. The reaction medium was a solution of sulfuric acid or a combination of sulfuric and oxalic acid in U.S. Pat. No. 5,032,244. The electrolyte formulation was 180 g/l sulfuric acid and the process temperature was +5 degrees C. A current density of 50 A/dm2 produced a coating with a thickness of 65 microns in 3 minutes. The microhardness of the obtained coating was between 200 and 300 HV.

A second process included the addition of 10 g/l oxalic acid at the same current density. A coating having a thickness of more than 60 microns and having a microhardness greater than 400 HV was obtained in 5 minutes.

After anodizing, the aluminum parts are typically rinsed and dried. Both anodizing, rinsing and drying is made in the same process chamber in all three US patents mentioned above. Some chambers have at least two aluminum parts (see U.S. Pat. No. 5,534,126 or 5,173,161). Others have a single part in each chamber (see U.S. Pat. No. 5,032,244).

Conventional batch anodizing has used square wave alternation of current or potential. This allows anodizing to be performed at higher current densities compared to anodizing with direct current. The pulse anodizing is characterized by a periodically alternation between a period with high current or voltage, during with the film is formed, and a period with low current or voltage, during which heat is dispersed (U.S. Pat. No. 3,857,766). This technique utilizes the "recovery effect", after a period of high formation rate (a pulse period), heat is allowed to disperse during the following period with low formation rate (a pause period) and defects in the coating are repaired before the current increases during the next pulse. The relative durations of the higher magnitude and lower magnitude currents determine the relative amount of oxide formation and heat dispersion. One such type of simple pulse pattern may be found in U.S. Pat. No. 3,857,766 or *Anodic Oxidation of Al. Utilizing Current Recovery Effect*, Yokohama, et al. Plating and Surface Finishing, 1982, 69 No. 7, 62-65.

U.S. Pat. No. 3,983,014, entitled Anodizing Means And Techniques, issued Sep. 28, 1976 to Newman et al., discloses another type of pulse pattern. The pulse pattern described in Newman has a high positive current portion, followed by a zero current portion, followed by a low negative current portion, followed again by a zero current portion. Each of the pulse portions represent one quarter of the cycle. Thus, the current has a high positive value during the first quarter of the cycle. No current is provided during the next quarter of the cycle. The current has a low negative value during the third quarter cycle. Zero current is provided during the final quarter of the cycle.

Another prior art pulse pattern is described in U.S. Pat. No. 4,517,059, issued May 14, 1985, to Loch et al. Loch discloses a pulse pattern that is a square wave alternating between a relatively high positive current and a relatively low negative current. The durations of the positive and negative portions of the pulses are controlled used in an attempt to control the anodizing process.

U.S. Pat. No. 4,414,077, issued Nov. 8, 1983, to Yoshida et al. describes a train of pulses superimposed on a dc current. The pulses are of a plurality opposite to that of the dc current.

Other prior art methods use a sinusoidal voltage wave, or portions thereof, applied to the voltage buses used for generating the anodizing currents (i.e. potentiostatic pulses). However, such prior art systems do not utilize current pulses for controlling the anodizing process. Examples of such prior art systems may be found in U.S. Pat. No. 4,152,221, entitled Anodizing Method, issued May 1, 1979, to Schaedel; U.S. Pat. No. 4,046,649, entitled Forward-Reverse Pulse Cycling Pulse Anodizing And Electroplating Process issued Sep. 6, 1977, to Elco et al; and U.S. Pat. No. 3,975,254, entitled Forward-Reverse Pulse Cycling Anodizing And Electroplating Process Power Supply, issued Aug. 17, 1976, to Elco et al.

Each of the aforementioned prior art methods, while utilizing a pulse of some sort, does not provide adequate hardness and thickness while maintaining a low reject rate. Moreover, such prior art systems are relatively slow and take a relatively long period of time to complete the anodizing process.

The time of each period is typically ranges from 1 to 100 seconds in the prior art, depending on the aluminum substrate. The prior art does not describe a correlation between a pulse pattern (pulse current, pulse duration, pause current and pause duration) and the result of the anodizing process. (See Yokogama, above). Thus, the optimal pulse conditions have been determined by trial and error. The coating quality of pulse anodized aluminum is generally superior to anodic coatings produce with direct current according to the prior art (Surface Treatment With Pulse Current, Dr. Jean Rasmussen, December 1994.)

An anodizing method and apparatus that reduces processing time with high formation potentials and minimal handling to obtain coatings of desirable quality and consistency is desirable. The process and apparatus will preferably lessen production costs and have a closed loop process design that reduces the impact of the electrolyte on internal and external environments. The process will preferably remove heat from near the component being anodized.

SUMMARY OF THE PRESENT INVENTION

According to one aspect of the invention a method of anodizing an aluminum component begins by placing an aluminum component in an electrolyte solution. Then a number of pulses are applied to the solution and component. Each pulse is formed by a pattern including a portion having a first magnitude, a portion having a second magnitude, and a portion having a third magnitude. The third magnitude is less than the first and second magnitudes, and all three magnitudes are of the same polarity.

According to one embodiment the third magnitude is substantially less than the first and second magnitudes. Another embodiment provides that the third magnitude is substantially zero.

A different embodiment has the pulse pattern include alternations between the first and second magnitudes, and following the alternations, the third magnitude. Another variation provides the pulse pattern having the first magnitude portion, followed by the second magnitude portion, followed by the first magnitude portion, and then followed by the third magnitude portion. Yet another embodiment includes the pulse pattern having the first magnitude portion, followed by the third magnitude portion, followed by the third magnitude portion.

A different embodiment includes the pulse pattern having the first, second and third magnitudes substantially constant. Another alternative provides that at least one of the first, second and third magnitudes is not constant.

Another embodiment has the duration of at least one of the second and third portions different from the duration of the first magnitude portion. An alternative includes applying the portions in the sequence of the first magnitude portion followed by the third magnitude portion, followed by the second magnitude portion. Another variation includes a pulse pattern having four or more different magnitudes.

An additional step of applying at least one additional pulse, having a different pulse pattern, is included in an alternative embodiment. The transition between magnitudes is fast in one embodiment, and slow in another.

According to a second aspect of the invention an apparatus for anodizing an aluminum component includes a reaction chamber, which has at least a portion of the component placed therein. The reaction chamber can hold a reaction fluid or electrolyte. A transport chamber is in fluid communication with the reaction chamber. The fluid enters the reaction chamber from the transport chamber through a plurality of inlets directed toward the component. The fluid follows a return path, such that the fluid returns from the reaction chamber to the transport chamber.

A fluid reservoir is provided in one alternative. The reservoir is in fluid communication with the transport chamber, and the return path includes the fluid reservoir. A pump between the fluid reservoir and the transport chamber pumps fluid to the transport chamber, thereby forcing the fluid through the inlets to the component in a plurality of jets directed at the component in a variation.

The reaction chamber has a substantially circular cross section, as does the transport chamber in various alternatives. The transport chamber may be substantially concentric with the reaction chamber.

In one embodiment the fluid is directed toward the component at an angle of between 15 and 90 degrees. In another embodiment the fluid is directed toward the component at an angle of between 60 and 70 degrees.

The reaction chamber is substantially vertical, and has at least one side wall and at least one bottom wall in another embodiment. The inlets are in the side wall such that the fluid enters the reaction chamber substantially horizontally. The reaction chamber has at least one outlet beneath the inlets. The outlet may be in the bottom wall.

The side wall is a common wall with the transport chamber in another embodiment. Also, the reaction chamber has a top with a removable portion, in an alternative. The top is adapted for mounting the component therein, and a portion of the component extends into the reaction chamber and a portion extends above the reaction chamber. The inlets are at the same height as at least a portion of the component in one alternative.

The component is held in a mounted position mechanically or pneumatically in various alternatives.

The inlet is the cathode, and the component is the anode, whereby current flows between the cathode and the anode in another embodiment.

Other principal features and advantages of the invention will become apparent to those skilled in the art upon review of the following drawings, the detailed description and the appended claims.

Figure 1:
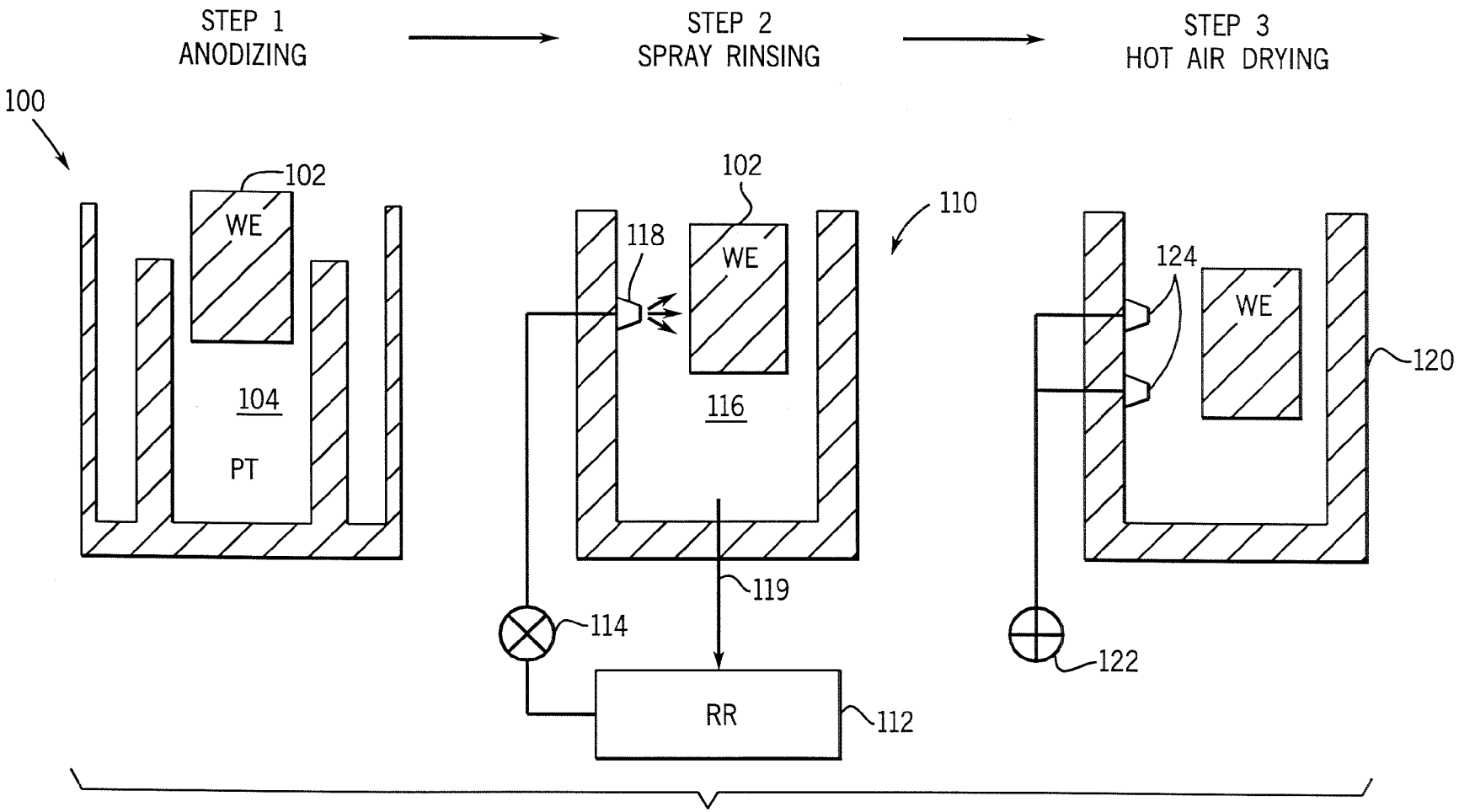
FIG. 1 is a block diagram of a general method implementing the present invention.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a particular process for anodizing and a particular fixture for holding an aluminum part and directing the electrolyte thereto, it should be understood at the outset that other process parameters, such as alternative material or solutions, or other apparatus may be employed to implement the invention.

The process and apparatus described herein is generally shown by a block diagram of FIG. 1. Anodizing occurs in a process container 100 (described in more detail later). A working electrode 102 (i.e. the part to be anodized) is placed in a reaction container 104, which is part of container 100. After anodizing part 102 is moved to a rinsing tank 110, where the working electrode is rinsed with D.I. water, pumped from a rinse reservoir 112 by a pressure pump 114 into a rinse chamber 116, through a set of spray nozzles 118. The rinse water leaves the rinse chamber 116 through a rinse outlet 119 and returns to the rinse reservoir 112. Working electrode or part 102 is mechanically held in position during the rinse. After rinsing, working electrode 102 is transferred to a drying container 120, where it is dried with hot air from a heater 122, which is pumped into the drying container 120 through several drying inlets 124.

Alternatives include performing multiple steps (such as anodizing and rinsing) in a single container or providing a station (following drying container 120, e.g.) that scan the component as a quality control measure. The scanning may be automatically performed using known techniques such as neural network analysis.

Figure 2:
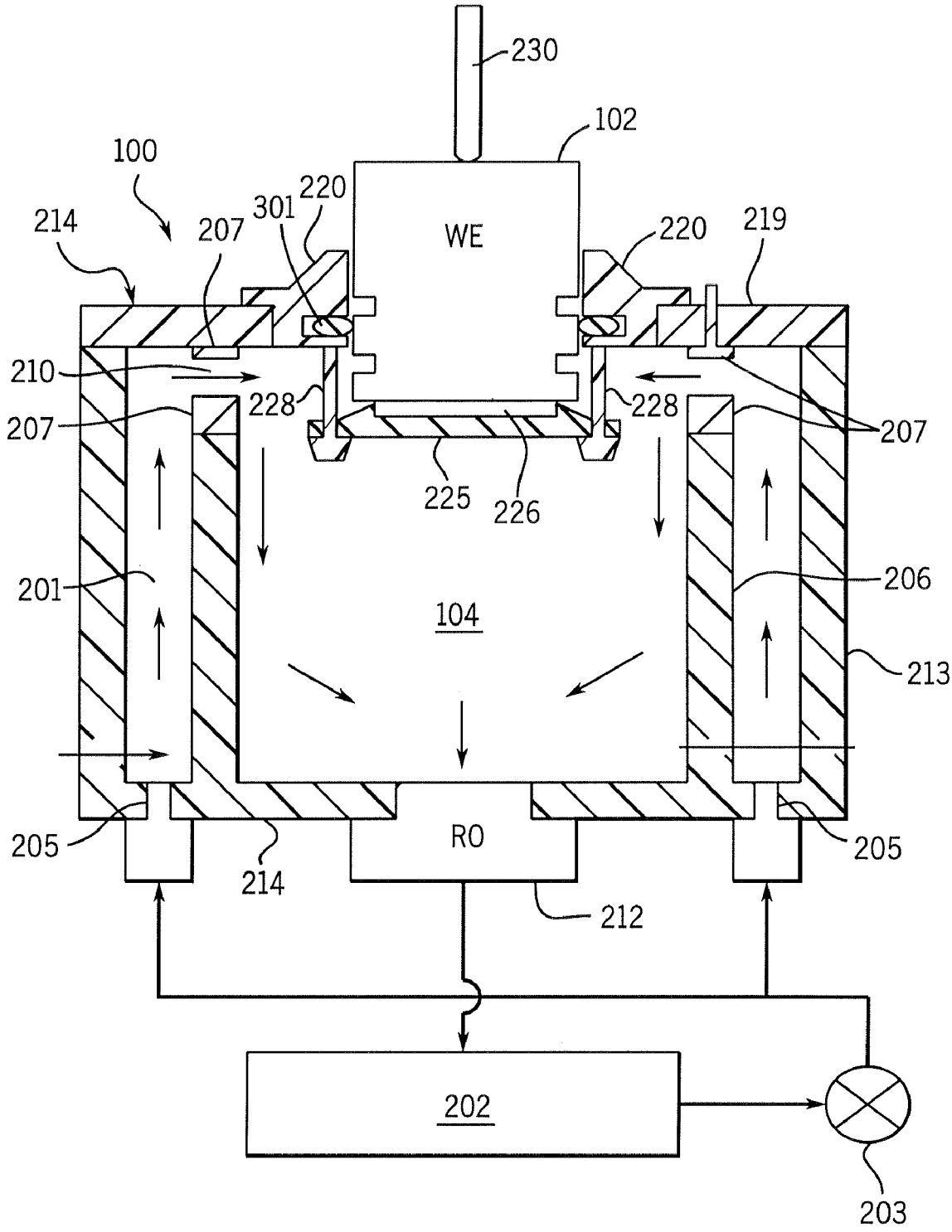
FIG. 2 is a schematic sectional view of process container implementing the present invention.

Referring now to FIG. 2, a schematic of a section of process container 100 and related components, is shown to comprise an outer circular transport chamber 201 and inner reaction container 104. The reaction medium (electrolytic solution) is transported from a medium reservoir 202, located below process container 100, by a pressure pump 203 into transportation chamber 201 through several inlet channels 205. Alternatives include other shaped chambers, as well as the inlets and outlets being in different locations.

Transportation channel 201 and reaction container 104 are separated by an inner wall consisting of a lower portion 206, made of an inert material, and an upper electrochemically active portion 207, which is the counter electrode. Alternatively, the entire wall may be the electrode. The reaction medium enters reaction container 104 through a set of reaction inlets 210 through counter electrode 207. The reaction medium enters reaction container 104 angled relative to the surface of the part, aluminum substrate, or working electrode 102. The angle to the part is within the range of 15 to 90 degrees, preferably 60 to 70 degrees.

The reaction medium leaves reaction container 104 through a reaction outlet 212 and returns to medium reservoir 202. The inner wall (comprised of portions 206 and 207), and an outer wall 213 are fixed to a bottom wall 214. Walls 206, 213 and 214 are comprised of an inert material, such as polypropylene. Reaction container 104 is closed by a moveable top lid made of an inert material such as polypropylene, which includes a cover lid 219 and a mounting fixture 220, and in which working electrode 102 is placed. Mounting fixture 220 is exchangeable and specially designed for the particular parts or working electrode 102 which is being anodized.

The upper portion of working electrode 102 is exposed to air, enhancing the dispersion of heat accumulated in working electrode 102 during processing. Working electrode 102 connected to a typical rectifier (controlled as discussed below) by an electrical contact 230, which is pressed against working electrode 102 after mounting.

Selective formation of coatings on working electrode 102 is ensured by a top mask consisting of a inert top jig 225 holding a rubber mask 226, which abuts the lower face of working electrode 102. The top mask is mounted to mounting fixture 220 by a number of adjustable fasteners 228, which are comprised of an inert material.

Figure 3:
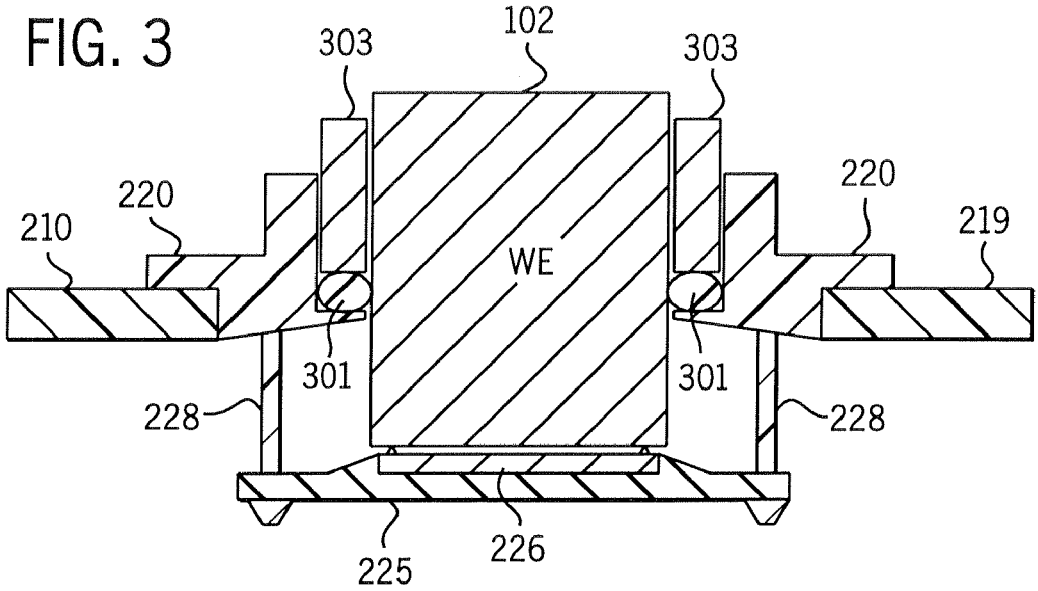
FIG. 3 is a detailed schematic sectional view a working electrode mounted in a mounting fixture, in accordance with the preferred embodiment.

Working electrode 102 mounted in mounting fixture 220 is shown in more detail in FIG. 3. Working electrode 102 is pressed against top mask, particularly rubber mask 226, and held in position by a rubber O-ring 301. Rubber O-ring 301 is compressed mechanically toward the top mask by a mounting ring 303. Working electrode 102 is removed by releasing the pressure on rubber O-ring 301, by moving mounting O-ring 302 away from the top mask.

Figure 4:
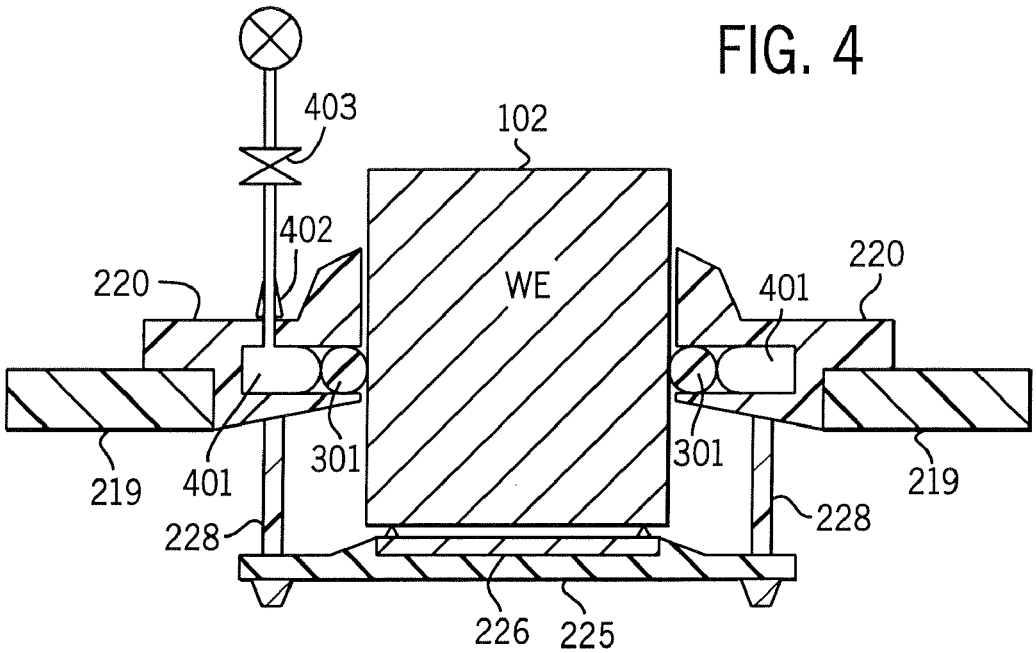
FIG. 4 is a detailed schematic sectional view a working electrode mounted in a mounting fixture, in accordance with the preferred embodiment.

FIG. 4 shows a pneumatic mounting design, in which O-ring 301 is pressed against working electrode 102 by pumping compressed air into a pressure tank 401 through several air inlets 402. The pressure on working electrode 102 is released by opening a pressure valve 403, so that working electrode 102 can be removed.

Figure 10:
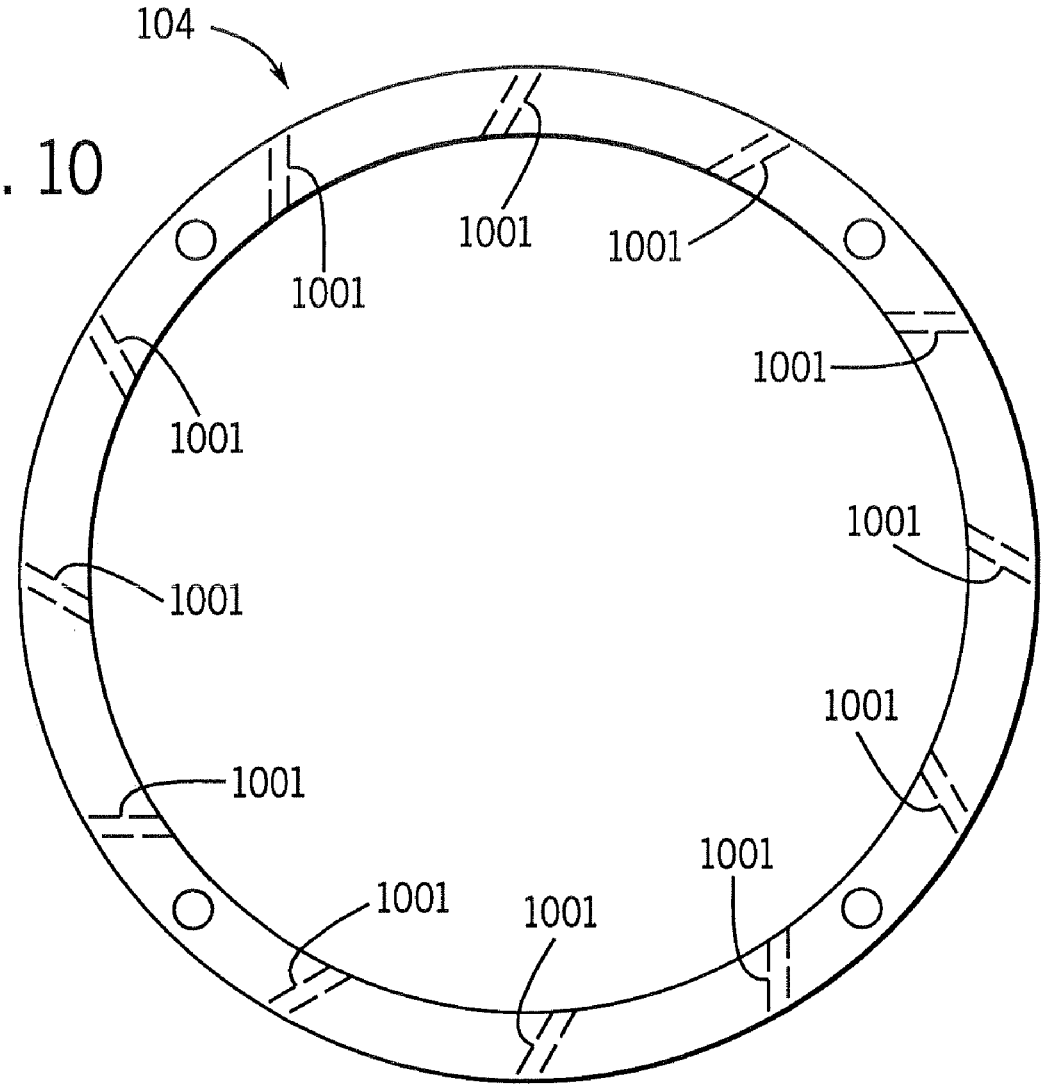
FIG. 10 is a top sectional view of an outer wall of a reaction chamber, with inlets in accordance with the preferred embodiment.

The reaction medium is sprayed toward the metallic substrate through holes in the counter electrode in a manner that reaction products (heat) are carried away from the metallic substrate (working electrode). FIG. 10 shows a top sectional view of reaction chamber 104. A plurality of inlets 1001 are shown, and are angled between 60 and 70 degrees. The mounting and masking device allows selective formation of coatings on the metallic substrate at high speed by applying a specially designed modulation of direct current or voltage characterized by periodically alternation from at least one period of high reaction potential and periods of no, low or negative reaction potential.

The apparatus discussed thus far has several advantageous (although not necessary) features. First, process container provides for flow of the reaction medium from a bulk solution below the container through the reaction chamber and back into the reservoir. Second, the reaction medium moves toward the working electrode at an angle so that heat may be quickly dissipated away from the working electrode. Third, the mounting, while easy to use and economical, allows for heat to be dissipated away from the top of the working electrode, which is exposed to air. Fourth, the reaction medium is sprayed toward the metallic substrate through holes in the counter electrode in a manner that reaction products, in addition to heat, are carried away from the metallic substrate (working electrode).

In addition to the apparatus described above, the inventive method using a reaction medium comprised of a solution of sulfuric acid or mixtures of sulfuric acid and suitable organic acids like oxalic acid. The concentration of sulfuric acid ranges from 1% v/v to 50% v/v, but preferably from 10% v/v to 20% v/v. The concentration range of one or more organic acids, added to the sulfuric acid electrolyte, is from 1% v/v to 50% v/v, but preferable from 10% v/v to 15% v/v. Working electrode 102 is an aluminum piston (aluminum 1295 or 1275, e.g.) acting as anode (connected positively to the rectifier) and the counter electrode 201 is aluminum 6062 (or titanium) acting as the cathode (connected negatively to the rectifier). The component may be made of other materials.

The electrolyte is stored and chilled to an appropriate process temperature ranging from −10 degrees C. to +40 degrees C., preferable between +10 degrees C. and +25 degrees C., in a reservoir below the reaction container. The electrolyte is pumped up into the reaction chamber at a flow rate from 4 LPM (Liter Per Minute) to 100 LPM, but preferable between 30 LPM and 50 LPM and returned to the reservoir.

The flow of direction of electrolyte is toward the aluminum surface so heat is transported away from the areas of heat production. Steady state heat dispersion is established by spraying the reaction medium at an angle from 15 to 90 degrees, but preferably between 60 and 70 degrees relative to the aluminum substrate surface.

The electrolyte is transported up to the reaction site in an outer circular inlet chamber and through the counter electrode toward the aluminum piston. The counter electrode contains from one to 50, but preferable from 8 to 12 transport inlets to the reaction chamber and is made of e.g. aluminum AA 6062, or other materials (such as titanium e.g). The counter electrode is connected to the rectifier and acts as cathode (negative).

The jet stream of electrolyte, angled toward the piston surface, establishes a steady state dispersion of heat away from the areas of production. Furthermore, dispersion of heat is enhanced gravitationally, when the electrolyte enters the lower part of the reaction chamber. The electrolyte leaves the reaction chamber at the outlet in the bottom of the reaction chamber and returns to the reservoir container below the reaction chamber.

The piston is mounted in the mounting fixture and is pressed toward the top mask in order to ensure masking of the piston crown. The piston is held in position by pressure from the rubber O-ring. The pressure on the O-ring is either mechanically as shown in FIG. 3 or pneumatic as in FIG. 4. The piston is then connected to the rectifier as anode (positive).

After anodizing, the electrical contact to the piston is removed and pressure is removed from the O-ring relaxes. The piston is then transferred to the rinsing container after which it is dried with hot air.

The design of the pulse current pattern of the preferred embodiment is a periodically alternation between perio s of very high current density (preferably more than 50 A/dm2), high current density (preferably more than 4 A/dm2), and low current density (preferably less than 4 A/dm2). The duration of each individual current density ranges from 0.12 seconds to 40 seconds, but preferable from 1 second to 5 seconds. The final number of repeated pulse cycles is determined by the specified nominal thickness of the oxide layer.

The duration of the period between a pulse, i.e., the transient time necessary for new stabilized conditions at the bottom of the pores for the new current conditions, is related to the difference between pulse and pause current density. Increased difference between the two current densities reduces the time necessary for 100% utilization of the recovery effect. Also, raising the temperature of the anodizing solution increases the transient time for the recovery effect. The transient time for the recovery effects during batch anodizing for cast aluminum containing high amounts of silicon (7% w/w) is between 10 and 25 seconds, depending in the process conditions.

A formation rate in the range of 25 microns per minute, nearly twice as fast as conventional direct current batch anodizing, requires a large difference in the pulse current densities, especially if the process temperature is above the typically range of conventional anodizing (>+5 degrees C.). Then inventor has learned that a pulse pattern having periodic alternation between three current densities in combination with increased process temperature (between +10 degrees C. and +15 degrees C.) and concentration of sulfuric acid (17% v/v) results in a coating thickness of 25 microns in less that one minute. Table 2 below shows various experimental data. The temperature and the amount of sulfuric acid in the anodizing electrolyte are generally higher than the maximum values in prior art anodizing.

Figure 5:
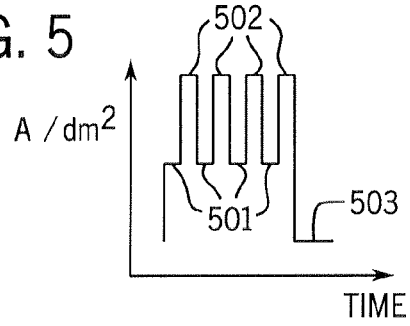
FIG. 5 is a graph showing an current pulse pattern in accordance with the present invention.

A pulse modulated current pattern (one cycle) in accordance with the present invention is shown in FIG. 5. Each cycle includes alternations between a medium current density 501 and a high current density 502, followed by a time of low (or zero) current density 503. This pattern is repeated several times until the final thickness of the anodic coating is reached.

The average current of the pulse patterns determines the formation rate. A comparison of formation rate, surface roughness and microhardness of aluminum piston batch processed under direct current conditions and with pulse modulated current is shown in Table 1.

TABLE 1

| | Direct Current | | Pulse |
|---|---|---|---|
| Temperature (C.) | 0 | 15 | 15 |
| Sulfuric Acid (% v/v) | 13 | 17 | 17 |
| Current Density (A/dm$^2$) | 24 | 25 | 25 |
| Formation rate (μm/min) | Fail | Fail | 22.4 |
| Surface roughness (μm) | N/A | N/A | 2.2 |
| Microhardness ($HV_{0.025}$) | N/A | N/A | 217 |

The inventor has learned, as shown in Table 1, that batch anodization of aluminum pistons is possible with high current density (>>3 A/dm2) if the recovery effect is utilized, as in the pulse current method of the present invention. The formation of heat during direct current anodizing disturbs the balance between formation and dissolution of the oxide film, resulting in a breakdown of the coating (the burning phenomena). The low microhardness for the pulse-anodized piston is a result of high heat production and insufficient removal of heat in a batch process.

Figure 6:
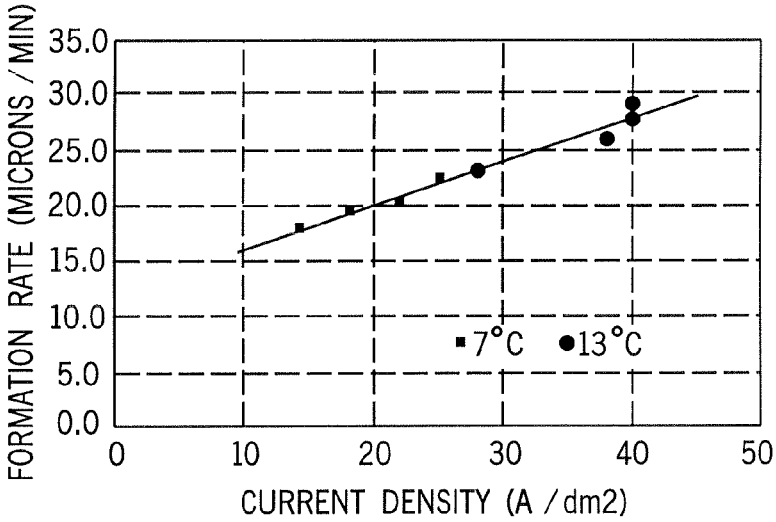
FIG. 6 is a graph showing formation rate vs. current density for two temperatures.

FIG. 6 is a graph showing that formulation rate depends on the average current density for various pulse patterns (in accordance with the pattern of FIG. 5), and that the formation rate is substantially independent of process temperatures between +7 degrees C. and +13 degrees C.

Figure 7:
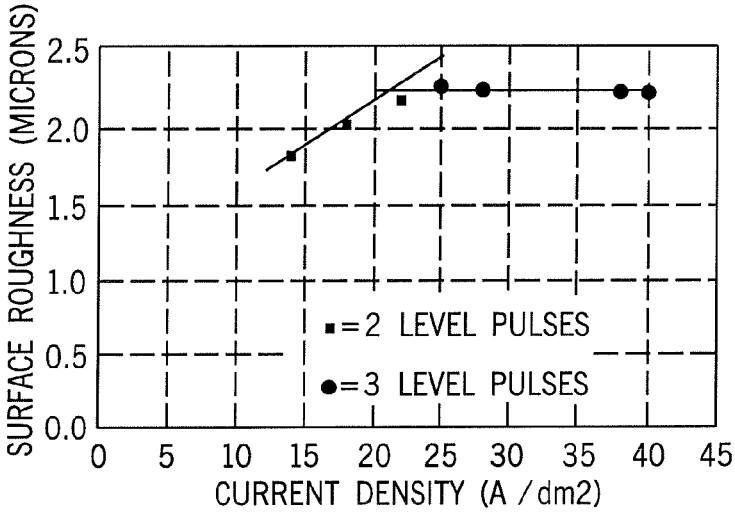
FIG. 7 is a graph showing surface roughness vs. average current density for two and three level pulse patterns.

Surface roughness increases with process time and current density for conventional batch anodizing using direct current. The surface roughness, measured as $R_a$, increases with average current density for pulse designs containing alteration between a pulse period and a pause (a two level pulse pattern). However, the surface roughness is independent of the average current density for pulse designs containing two pulses and a pause period (a three level pulse patter such as that of FIG. 5). This is shown in the graph of FIG. 7, which plots surface roughness vs. current density for two and three level pulses. The surface roughness for three level pulse patterns changed from 1.6 microns prior to anodizing to 2.2 microns after anodizing, which is approximately a 38% increase. The pulse designs of the experiments are shown in table 2 below, and generally include a pulse pattern having two relatively high current portions (33 A/dm$^2$ and (33 A/dm$^2$ e.g.) and a third portion have a substantially lower current portion (less than one-half, and preferably about one-tenth, e.g.). The electrolyte contained 17% v/v sulfuric.

TABLE 2

1) 10 s at 20 A/dm$^2$, 5 s at 2 A/dm$^2$, repeated 3 times at 15° C.
2) 10 s at 26 A/dm$^2$, 5 s at 2 A/dm$^2$, repeated 3 times at 15° C.
3) 10 s at 33 A/dm$^2$, 5 s at 2 A/dm$^2$, repeated 3 times at 15° C.
4) 5 s at 33 A/dm$^2$, 2 s at 53 A/dm$^2$, 3 s at 33 A/dm$^2$, 5 s at 2 A/dm$^2$, repeated 3 times at 15° C.
5) 2 s at 33 A/dm$^2$, 2 s at 53 A/dm$^2$, 1 s at 33 A/dm$^2$, 2 s at 53 A/dm$^2$, 3 s at 33 A/dm$^2$, 5 s at 2 A/dm$^2$, repeated 3 times at 7° C.
6) 2 s at 33 A/dm$^2$, 2 s at 53 A/dm$^2$, 1 s at 33 A/dm$^2$, 2 s at 53 A/dm$^2$, 1 s at 33 A/dm$^2$, 2 s at 53 A/dm$^2$, 5 s at 2 A/dm$^2$, repeated 3 times at 7° C.
7) 2 s at 33 A/dm$^2$, 2 s at 59 A/dm$^2$, 1 s at 33 A/dm$^2$, 2 s at 59 A/dm$^2$, 1 s at 33 A/dm$^2$, 2 s at 59 A/dm$^2$, 5 s at 2 A/dm$^2$, repeated 3 times at 7° C.

Alternatives include fewer repetitions, varying the order of the different magnitudes, having one pulse pattern different from the other pulse patterns, and providing zero current in the low current portion.

Figure 8:
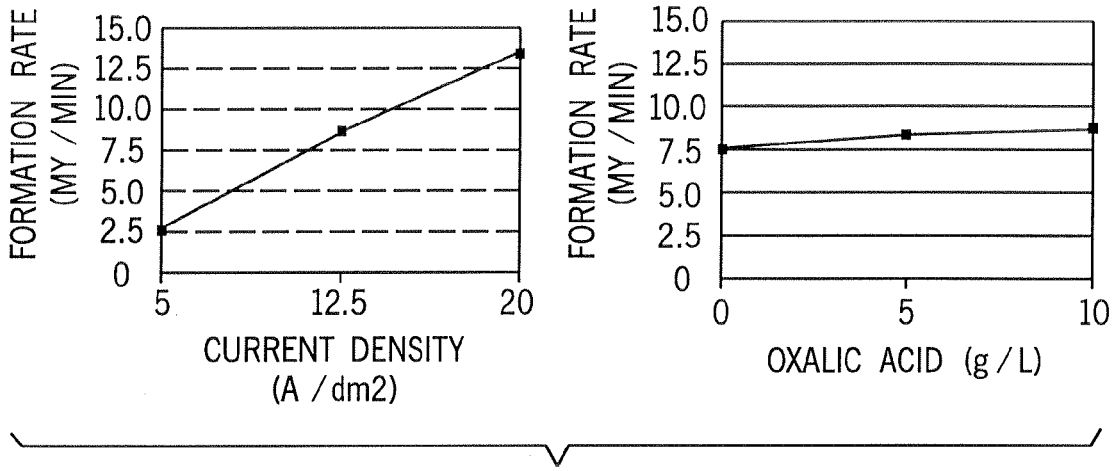
FIG. 8 PRIOR ART
FIG. 8 is a graph showing formation rate vs. average current density for two prior art processes.
Figure 9:
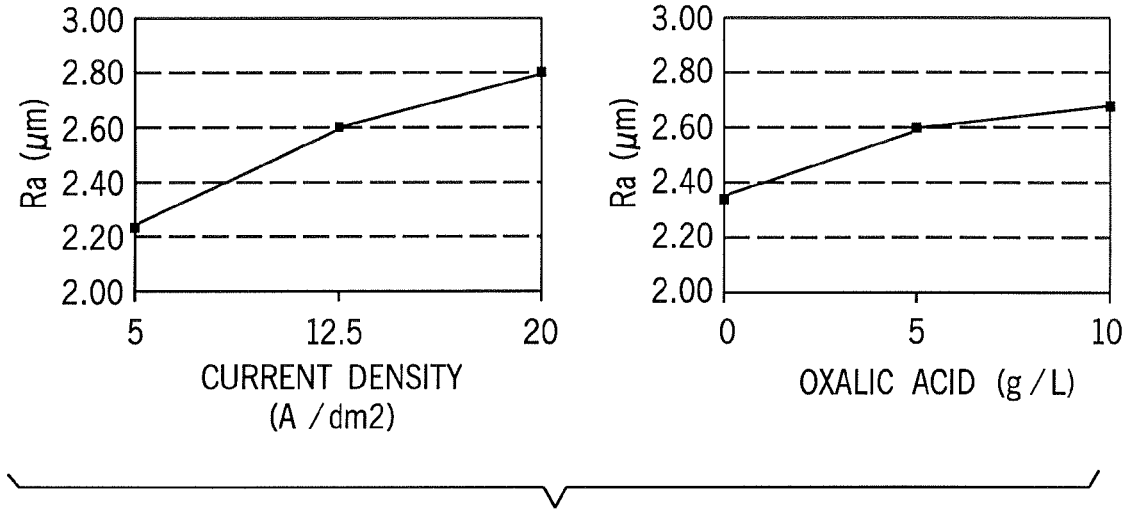
FIG. 9 PRIOR ART
FIG. 9 is a graph showing surface roughness vs. average current density for two prior art processes.

The formation rate and surface roughness of direct current anodized pistons according to process principles in U.S. Pat. Nos. 5,534,126 and 5,032,244, where the electrolyte is sprayed orthogonal toward the piston head, is shown in FIGS. 8 and 9. The roughness and formation rate provided by these prior art processes is not as good as the roughness and formation rate provided by the present invention. The prior art formation rate increases with current density in sulfuric acid electrolytes. Also, there is a slightly increased formation rate by addition of oxalic acid. The surface roughness increases with current density and by addition of oxalic acid. Anodizing at 20 A/dm2 in a sulfuric acid electrolyte containing 10 g/l oxalic acid produces in 90 seconds 24 μm oxide coating in 90 seconds. The surface roughness is 2.64 μm. Raising the current density to 30 A/dm2, the formation rate increases and 23 μm coating is produced in 1 minute, but the surface roughness increases to 3.01 μm. For comparison, the surface roughness of pistons after conventional direct current anodizing at 0 degrees C. and at 3 A/dm2, is 2.66 microns.

Numerous modifications may be made to the present invention which still fall within the intended scope hereof. Thus, it should be apparent that there has been provided in accordance with the present invention a method and apparatus for anodizing parts that provides a fixtures that disperses heat from the part, and provides an anodizing current in a pulsed pattern such that the anodization is faster and/or has desirable properties that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A method of electrolytically treating a component comprising the steps of:

providing the component;

placing at least a portion of the component in an electrolyte solution in a reaction chamber;

directing the electrolyte solution into the reaction chamber and toward the component through a plurality of inlets as a plurality of jets directed at the component;

providing an exit path from the reaction chamber for the electrolyte solution; and applying a plurality of pulses to the solution and the component while the electrolytic solution is being directed into the chamber, wherein the pulses have a pattern comprised of at least a first magnitude portion, a second magnitude portion, and a third magnitude portion, wherein the third magnitude is less than the first and second magnitudes, and wherein all three magnitudes are of the same polarity.

2. The method of claim 1 wherein the third magnitude is substantially less than the first and second magnitudes.

3. The method of claim 2 wherein the pulses are current pulses and the step of applying a plurality of pulses includes the steps of:

providing a substantially constant current magnitude during the first magnitude portion;

providing a substantially constant current magnitude during the second magnitude portion; and providing a substantially constant current magnitude during the second magnitude portion.

4. The method of claim 2 wherein at least one of the first, second and third magnitudes is not constant.

5. The method of claim 1 wherein the third magnitude is substantially zero.

6. The method of claim 1 wherein the pulse pattern includes the sequence of alternations between the first and second magnitudes, and following the alternations, the third magnitude.

7. The method of claim 1 wherein the duration of the first magnitude portion of the pulse is different than the duration of at least one of the second and third portions.

8. The method of claim 1 wherein the step of applying a plurality of pulses includes the step of applying a pulse pattern having four portions.

* * * * *